US005571655A

United States Patent [19]

Mahabadi et al.

[11] Patent Number: 5,571,655

[45] Date of Patent: Nov. 5, 1996

[54] TONER REACTIVE MELT MIXING PROCESS

[75] Inventors: Hadi K. Mahabadi, Etobicoke; Michael S. Hawkins, Cambridge; Gerald R. Allison; Sheau V. Kao, both of Oakville; Paul J. Gerroir, Oakville; Nam S. Ro, Mississauga; Enno E. Agur, Toronto, all of Canada

[73] Assignee: Xerox Corporation, Stamford, Conn.

[21] Appl. No.: 425,014

[22] Filed: Apr. 17, 1995

[51] Int. Cl.[6] ..... G03G 9/00

[52] U.S. Cl. ..... 430/137; 430/904; 514/495

[58] Field of Search ..... 430/137, 109, 430/904; 524/495; 523/215

[56] References Cited

U.S. PATENT DOCUMENTS

| | | | |
|---|---|---|---|
| 3,590,000 | 6/1971 | Palermiti et al. | 252/62.1 |
| 3,681,106 | 8/1972 | Burns et al. | 117/17.5 |
| 3,842,032 | 10/1974 | Sato et al. | 523/215 |
| 3,941,898 | 3/1976 | Sadamatsu et al. | 427/18 |
| 4,340,660 | 7/1982 | Kiuchi et al. | 430/109 |
| 4,565,763 | 1/1986 | Uchiyama et al. | 430/137 |
| 5,227,460 | 7/1993 | Mahabadi et al. | 528/272 |
| 5,376,494 | 12/1994 | Mahabadi et al. | 430/137 |

*Primary Examiner*—Christopher D. Rodee
*Attorney, Agent, or Firm*—E. O. Palazzo

[57] ABSTRACT

Low fix temperature toners are fabricated by a two step melt mixing and reactive melt mixing process wherein there is initially prepared, for example, using a melt mixing device, a composite of pigment and resin, followed by crosslinking of the resin component at high temperature and high shear to produce a partially crosslinked toner with substantially no unpigmented gel domains. The toners are particularly suitable for high speed fusing, show excellent offset resistance and wide fusing latitude, and superior vinyl offset properties.

27 Claims, 2 Drawing Sheets

TONER REACTIVE MELT MIXING PROCESS

The present invention is generally directed to processes for the preparation of toner compositions. More specifically, the present invention relates to melt mixing processes, batch or continuous, but preferably continuous processes such as, for example, reactive extrusion for preparing crosslinked toners using a two step melt mixing process, the first step including melt mixing a reactive base resin with pigment and optionally other toner additives to form a polymer composite, followed by the addition thereof to an extruder as a feed together with additional polymer and a free radical initiator, such as benzoyl peroxide. In embodiments, the process of the present invention enables the coating of the selected pigment particles and other toner additive with resin polymer like polyester prior to the crosslinking thereof in an extruder; thus for example the pigment, such as carbon black can be passivated, and with the processes of the present invention in embodiments crosslinking inhibition of the resin is eliminated or minimized, and there is facilitated the dispersion of pigment particles throughout the toner resin. Yet more specifically, the present invention relates to processes for crosslinking reactive linear resins in presence of pigment for the preparation of crosslinked toners that contain crosslinked gel domains impregnated with pigment particles and other toner additives, and that can be selected for application in heat fixable toners with superior fusing and vinyl offset performance.

BACKGROUND OF THE INVENTION

Toner utilized in development in the electrographic process is generally prepared by mixing and dispersing a colorant and a charge enhancing additive into a thermoplastic binder resin, followed by micropulverization. As the thermoplastic binder resin, several polymers are known including polystyrenes, styrene-acrylic resins, styrene-methacrylic resins, styrene-butadiene resins, polyesters, epoxy resins, acrylics, urethanes and copolymers thereof. As the colorant, carbon black is normally utilized and as the charge enhancing additive, alkyl pyridinium halides, distearyl dimethyl ammonium methyl sulfate, and the like are known.

To fix the toner to a support medium, such as a sheet of paper or transparency, hot roll fixing is commonly used. In this method, the support medium carrying a toner image is transported between a heated fuser roll and a pressure roll with the image face contacting the fuser roll. Upon contact with the heated fuser roll, the toner melts and adheres to the support medium forming a fixed image. Such a fixing system can be very advantageous in heat transfer efficiency.

Fixing performance of the toner can be characterized as a function of temperature. The lowest temperature at which the toner adheres to the support medium is referred to as the Cold Offset Temperature (COT), and the maximum temperature at which the toner does not adhere to the fuser roll is referred to as the Hot Offset Temperature (HOT). When the fuser temperature exceeds HOT, some of the molten toner adheres to the fuser roll during fixing and is transferred to subsequent substrates containing developed images resulting, for example, in blurred images. This undesirable phenomenon is referred to as offsetting. Between the COT and HOT of the toner is the Minimum Fix Temperature (MFT) which is the minimum temperature at which acceptable adhesion of the toner to the support medium occurs, as determined by, for example, a creasing test. The difference between MFT and HOT is referred to as the Fusing Latitude.

The hot roll fixing system and a number of toners used therein can, however, exhibit several problems, for example the binder resins in the toners can require a relatively high temperature in order to be affixed to the support medium. This may result in high power consumption, low fixing speeds, and reduced life of the fuser roll and fuser roll bearings. Also, offsetting can be a problem, and further, toners containing vinyl type binder resins, such as styrene-acrylic resins, may have an additional problem which is known as vinyl offset. Vinyl offset occurs when a sheet of paper or transparency with a fixed toner image comes in contact for a period of time with a polyvinyl chloride (PVC) surface containing a plasticizer used in making the vinyl material flexible such as, for example, in vinyl binder covers, and the fixed image adheres to the PVC surface.

There is a need for a toner with low fix temperature and high offset temperature (or wide fusing latitude) and superior vinyl offset property, and processes for the preparation thereof. Toners which function at lower temperatures would reduce the power needed for operation and increase the life of the fuser roll and the high temperature fuser roll bearings. Additionally, such low melt toners, that is, for example, toners with a MFT lower than 200° C., and preferably lower than 160° C. would reduce the volatilization of release oil such as silicone oil which may occur during high temperature heating operation and which can cause problems when the volatilized oil condenses in other areas of the machine. In particular, toners with a wide fusing latitude and with acceptable toner particle elasticity are needed. Toners with wide fusing latitude can provide flexibility in the amount of oil needed as release agent and can minimize copy quality deterioration related to toner offsetting to the fuser roll. These toners are provided with the present invention and processes thereof.

To prepare lower fix temperature resins for toner, the molecular weight of the resin may be lowered. Low molecular weight and amorphous polyester resins and epoxy resins have been used to prepare low temperature fixing toners. For example, attempts to generate toners utilizing polyester resins as binder are disclosed in U.S. Pat. No. 3,590,000 to Palermiti et al. and U.S. Pat. No. 3,681,106 to Burns et al. The minimum fixing temperature of polyester binder resins can be rendered lower than that of other materials, such as styrene-acrylic resins. However, this may lead to a lowering of the hot offset temperature and, as a result, decreased offset resistance. In addition, the glass transition temperature of the resin may be decreased, which may cause the undesirable phenomenon of blocking of the toner during storage.

To prevent fuser roll offsetting and to increase fusing latitude of toners, modification of the binder resin structure by conventional polymerization processes, for example by branching, crosslinking, and the like, has been attempted. For example, in U.S. Pat. No. 3,681,106 to Burns et al., a process is disclosed whereby a polyester resin was improved with respect to offset resistance by nonlinearly modifying the polymer backbone by mixing a trivalent or more polyol or polyacid with the monomer to generate branching during polycondensation. However, an increase in degree of branching may result in an elevation of the minimum fix temperature. Thus, any initial advantage of low temperature fix may be diminished.

Another method of improving offset resistance is by crosslinking during polymerization. In U.S. Pat. No. 3,941,898 to Sadamatsu et al., for example, a crosslinked vinyl type polymer prepared using conventional crosslinking was used as the binder resin. Similar disclosures for vinyl type resins are presented in U.S. Pat. Nos. 31,072 (a reissue of 3,938,992); 4,556,624; 4,604,338 and 4,824,750. Also, disclosures have been made of crosslinked polyester binder resins using conventional polycondensation processes for improving offset resistance, such as for example in U.S. Pat. No. 3,681,106.

While significant improvements can be obtained in offset resistance and entanglement resistance, a major drawback may ensue with these kinds of crosslinked resins prepared by conventional polymerization, both vinyl type processes including solution, bulk, suspension and emulsion polymerizations and polycondensation processes. In these processes, monomer and crosslinking agent are added to the reactor. The crosslinking reaction is not very fast and chains can grow in more than two directions at the crosslinking point by the addition of monomers. Three types of polymer configurations are produced—a linear and soluble portion called the linear portion, a crosslinked portion which is low in crosslinking density and, therefore, is soluble in some solvents like tetrahydrofuran, toluene and the like, and is referred to as a sol, and a portion comprising highly crosslinked gel particles, which is not soluble in substantially any solvent like tetrahydrofuran, toluene and the like, and is referred to as the gel. The second portion with low crosslinking density (sol) is responsible for widening the molecular weight distribution of the soluble part which results in an elevation of the minimum fixing temperature of the toner. Also, a drawback of these processes, which are not accomplished under high shear, is that as more crosslinking agent is used the gel particles or very highly crosslinked insoluble polymer with high molecular weight increase in size. The large gels can be more difficult to disperse pigment in, causing unpigmented toner particles during pulverization, and toner developability may thus be hindered. Also, in the case of vinyl polymers, the toners produced often show vinyl offset.

Crosslinked polyester binder resins prepared by conventional polycondensation reactions have been provided for improving offset resistance such as, for example, as illustrated in U.S. Pat. No. 3,681,106. As with crosslinked vinyl resins, increased crosslinking as obtained in such conventional polycondensation reactions may cause the minimum fix temperature to increase. When crosslinking is accomplished during polycondensation using tri-or polyfunctional monomers as crosslinking agents with the polycondensation monomers, the net effect is that apart from obtaining highly crosslinked high molecular weight gel particles, which are not soluble in substantially any solvent, the molecular weight distribution of the soluble part widens due to the formation of sol or crosslinked polymer with a very low degree of crosslinking, which is soluble in some solvents. These intermediate molecular weight species may result in an increase in the melt viscosity of the resin at low and high temperature, which can cause the minimum fix temperature to increase. Furthermore, gel particles formed in the polycondensation reaction which is carried out using conventional polycondensation in a reactor with low shear mixing can grow rapidly with increase in degree of crosslinking. As in the case of crosslinked vinyl polymers using conventional polymerization reactions, these large gel particles may be more difficult to disperse pigment in, resulting in unpigmented toner particles after pulverization, and thus hindering developability.

Crosslinked polyester binder resins prepared by a reactive melt mixing process has been disclosed in U.S. Pat. No. 5,227,460, the disclosure of which is totally incorporated herein by reference. In this process in embodiments, the crosslinking reaction is accomplished with a chemical initiator when the polymer is in the molten state. The crosslinked resin comprises crosslinked portions and linear portions. The crosslinked portions comprise very high molecular weight densely crosslinked gel particles having an average diameter of less than about 0.1 micron and are insoluble in substantially any solvent. The linear portion comprises low molecular weight resin soluble in various common solvents. Substantially no portion of the resin comprises sol or polymer with low degree of crosslinking. The crosslinked portions or microgel particles are prepared in such a manner that there is substantially no distance between the polymer chains. This crosslink structure is different from conventional crosslinking in which the crosslink distance between chains is quite large with several monomer units. The highly crosslinked microgel particles distributed throughout the linear portion impart elasticity to the resin which improves the resin offset properties, while not substantially effecting the resin minimum fix temperature. This melt mixing process in U.S. Pat. No. 5,227,460 is in embodiments a reactive melt mixing process whereby a base resin is converted into a resin with crosslinked fraction.

Many processes are known for effecting polymerization reactions, including reactive melt mixing processes, for both initial polymerization reactions employing monomers or prepolymers, and for polymer modification reactions, such as grafting, coupling, crosslinking and degradation reactions. The process is known as reactive extrusion process when the melt mixing device is an extruder. The reactive extrusion process is particularly advantageous for polymer modifications in many respects. The modification generally takes place when the polymer is in molten state, thus eliminating the use of a large amount of solvent whose handling is both difficult and costly. The extrusion process is inherently easier to control as compared to a large polymerization reactor vessel.

Melt mixing processes for preparing toner based on crosslinked polyester binder resin prepared by conventional approach in a reactor or by reactive processing are known, such as those disclosed and illustrated in U.S. Pat. No. 5,376,494 and U.S. Pat. No. 5,227,460, the disclosures of which are totally incorporated herein by reference. In these processes, the partially crosslinked resin prepared by the reactive extrusion process or any conventional methods is subsequently melt blended again with a colorant, charge enhancing additives and the like to result in a toner mixture before pulverizing operation to obtain toner particles. However, even with crosslinking via reactive extrusion where very small gel domains are produced, large aggregates of gel domains, sometimes on the order of 1 to 5 microns, can form in subsequent melt mixing processes and under certain extrusion conditions.

These large gel aggregates are difficult for pigment particles and other toner additives to penetrate, thus generating unpigmented particles during pulverization. The lack of pigment can result in differences in specific gravity and triboelectric charging between the unpigmented particles and toner particles containing pigment and other additives. As a result, some of the unpigmented gel particles will be removed with fines during classification operation affecting, therefore, the toner fusing property. Furthermore, the unpigmented particles that remain in toner will charge differently from toner particles containing pigment and additives. Thus, the development properties of the toner will also be adversely affected.

Therefore, there remains a need for a fabrication processes which can eliminate the occurrence of unpigmented gel particles and avoid or minimize the other disadvantages illustrated herein.

SUMMARY OF THE INVENTION

Embodiments of the present invention overcome the above-discussed problems of the prior art, and the processes of the present invention possess the additional advantages indicated herein, such as avoiding or minimizing the formation of unpigmented gel in the toner particles. Another advantage of the processes of the present invention is the improvement in pigment dispersion which can be realized through a two step mixing process for pigment by accomplishing pigment dispersion prior to the resin crosslinking operation. The present invention provides an economical, robust and reproducible process for preparing resins and toner thereof by batch or continuous process. Specifically, the present invention provides a reactive melt mixing process to generate low cost toners containing partially crosslinked thermoplastic binder resins with no unpigmented particles thereof, and which toners possess a low fix temperature and high offset temperature, and which evidence minimized or substantially no vinyl offset. In this process, there is initially prepared a polymer composite of pigment and polymer by a melt mixing processes. Subsequently, the resulting polymer composite is crosslinked in the molten state under high temperature and high shear conditions producing substantially uniformly dispersed pigment containing microgels of a high crosslinking density, preferably using chemical initiators as crosslinking agents in an extruder, preferably without utilizing monomer for crosslinking, and with minimized or no residual materials remaining in the resin after crosslinking.

In embodiments, the present invention is directed to a process for the preparation of toner compositions comprising (a) preparing a polymer composite of reactive base resin and pigment by melting the base resin and enabling dispersing of pigment in said resin; and (b) melting by heating and shearing the resultant composite of (a)with optional additional base resin and free radical initiator, thereby forming a polymer composite melt of resin, initiator, and pigment, and crosslinking the resin component to form a crosslinked toner resin with substantially no unpigmented gel domains; and a process for the preparation of toner compositions comprising (a) preparing a polymer composite comprised of a reactive base resin, pigment and toner additives by melting the base resin, and dispersing pigment and toner additives in said base resin; and (b) melting the resultant composite by heating and shearing the resulting polymer composite base resin and free radical initiator, thereby forming a polymer composite; and partially crosslinking the resin component by heating to form a crosslinked toner resin with substantially no unpigmented gel domains.

In the process of the present invention, a reactive resin (hereinafter referred to as the base resin), such as, for example, unsaturated linear polyester resin, is dry blended first with a pigment, such as, for example, carbon black like REGAL 330®, either according to the weight ratio of pigment to resin in the final toner or at a higher ratio. The blended mixture is then melt mixed in a batch or continuous melt mixing device, such as, for example, a continuous extruder, to effect complete dispersion and wetting of the pigment particles by the molten resin. The molten composite is then cooled down and ground down to about 1 millimeter in size using devices, such as, for example, a mechanical impact mill or equivalent. The resultant composite particles together with an initiator and additional resin, if necessary to let down the pigment concentration to that of the toner, is then added again to a melt mixing device, wherein the resin is crosslinked in the presence of pigment in the molten state and under high temperature and high shear conditions, about 10,000 to about 20,000 rpm, preferably using a chemical initiator, such as, for example, organic peroxide, as a crosslinking agent without forming any significant amounts of residual materials. Thus, the removal of byproducts or residual unreacted materials is not needed with embodiments of the process of the invention. In preferred embodiments of this process, the base resin and pigment are preblended first and fed to a melt mixing device, such as an extruder, followed by pelletizing and grinding to reduce the composite particles to about 1 millimeter in size diameter. The resulting composite particles are then introduced into an extruder together with additional resin, and free radical initiator to crosslink the reactive resin in a reactive extrusion reaction. An extruder screw configuration, length and temperature may be used which enables the initiator to be well dispersed in the polymer melt before the onset of crosslinking, and further, which provide a sufficient, but short, residence time for the crosslinking reaction to be carried out. Adequate temperature control enables the crosslinking reaction to be carried out in a controlled and reproducible fashion. Extruder screw configuration and length can also provide high shear conditions to distribute microgels, formed during the crosslinking reaction, well in the molten mixture, and to keep the microgels from inordinately increasing in size with increasing degree of crosslinking. An optional devolatilization zone may be used to remove any volatiles, if needed. The molten mixture may then be pumped through a die to a pelletizer. Additional toner additive or additives can be introduced in either of the two melt mixing operations so that a toner precursor can be obtained after the reactive extrusion step.

The process steps of the present invention in embodiments comprise (1) dry blending a pigment and optionally toner additives with the base resin; (2) adding the blend to a melt mixing device; (3) melting the base resin and dispersing the pigment and optional additives; and wherein the pigment is coated with the base resin; (4) discharging and cooling the molten mixture before reducing it to 1 millimeter particles; (5) adding the resultant composite particles with a chemical initiator and additional base resin and toner additives to a melt mixing device; (6) melting the resin component and dispersing the initiator; (7) initiating crosslinking of the base resin in the presence of pigment by increasing the temperature; (8) optionally adding additional toner additives; (9) optionally devolatilizing the melt to remove any effluent volatiles; and (10) discharging the molten mixture to a cooling device. The solidified toner precursor can then be pulverized and classified to obtain particles of desirable size and distribution.

The toner resin modified during reactive blending in the process of the present invention comprises crosslinked portions and linear portions. The crosslinked portions which comprise very high molecular weight densely crosslinked gel particles containing well dispersed pigment and other toner additives and having average diameter less than about 0.3 microns, are insoluble in substantially any solvent, including tetrahydrofuran, toluene and the like. The linear portion comprises low molecular weight resin soluble in various solvents such as, for example, tetrahydrofuran, toluene and the like. The high molecular weight highly crosslinked gel particles are substantially uniformly distributed in the linear portions. Substantially no portion of the resin comprises sol or low crosslinked density polymer, such as that which would be obtained in conventional crosslinking processes such as polycondensation, bulk, solution, suspension, emulsion and dispersion polymerization processes. The toner precursor after the reactive blending step comprises very well dispersed pigment particles distributed evenly throughout the toner resin. There is, therefore, substantially no unpigmented gel domains frequently found in toner precursor prepared by procedures described previously in copending patent applications wherein the resin is crosslinked before pigment dispersion.

The process of the invention can be utilized to produce a low cost, safe crosslinked toner with substantially no unreacted or residual byproducts of crosslinking, and no or very minimal unpigmented gel particles, and which can be sufficiently fixed at low temperature by hot roll fixing to afford energy saving, are particularly suitable for high speed fixing, show excellent offset resistance and wide fusing latitude (e.g., low fix temperature and high offset temperature), and evidence minimized or no vinyl offset.

DETAILED DESCRIPTION OF PREFERRED EMBODIMENTS

Figure 1:
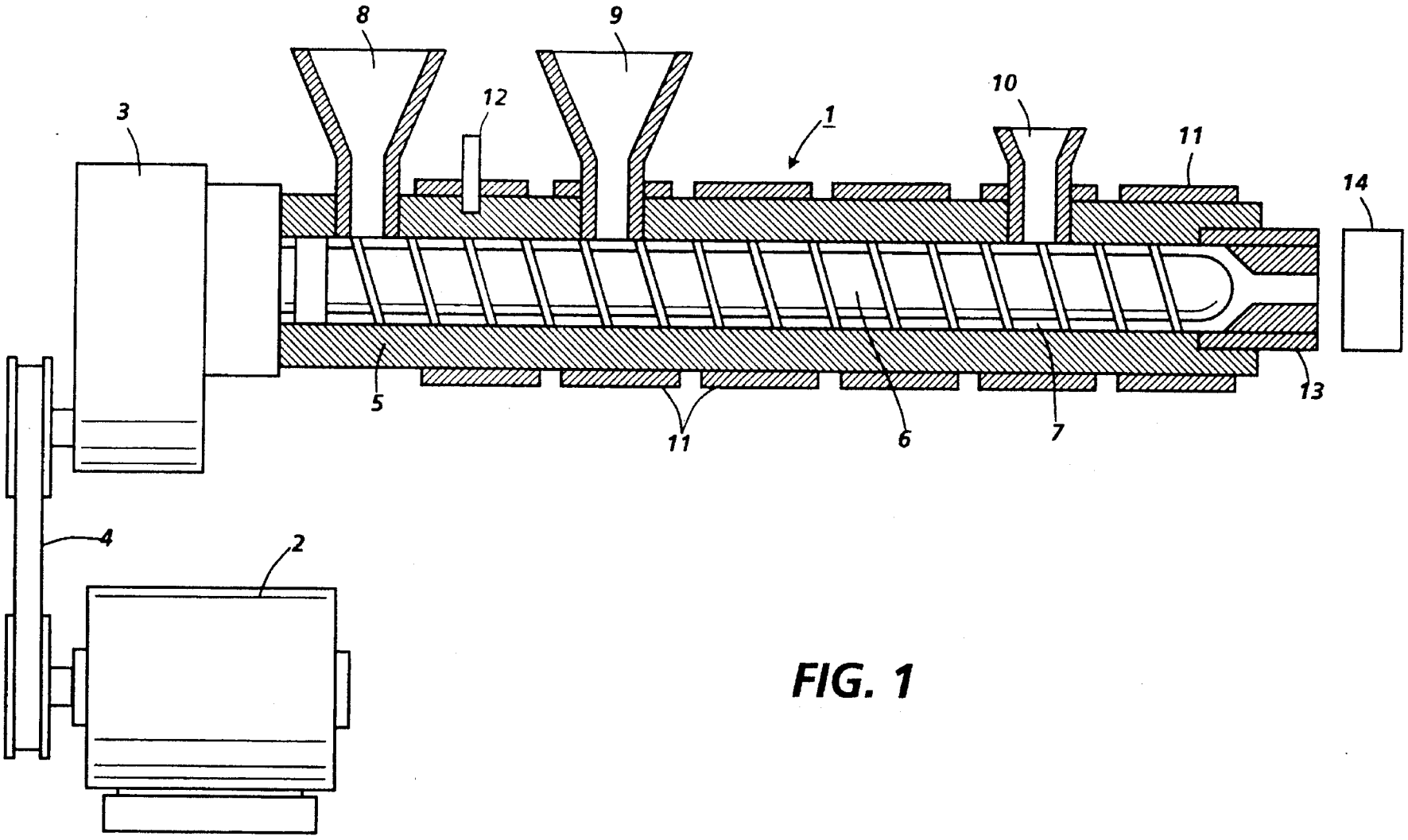
FIG. 1 is a partially schematic cross-sectional view of a reactive extrusion apparatus suitable for the process of the present invention.

The present invention provides a process for fabricating low fix temperature toners by a two step process including a compounding and a reactive melt mixing operation in any melt mixing device, batch or continuous, but preferably continuous such as, for example, an extruder wherein polymer base resins are first mixed with pigment and other additives, and subsequently crosslinked at high temperature and under high shear conditions, preferably using chemical initiators as crosslinking agents. Crosslinked toner resins prepared by the process of the invention are disclosed in detail in U.S. Pat. No. 5,227,460, the disclosure of which is hereby totally incorporated herein by reference.

Low fix temperature toners thereof can be prepared by a two step compounding and reactive melt mixing process comprising the steps of first preparing a composite of pigment and resin followed by a second step of mixing the composite with additional resin, and free radical initiator. The first step comprises (1) dry blending a pigment and optionally toner additives with base resin; (2) adding the blend to a melt mixing device; (3) melting the base resin and dispersing the pigment and optional additives; and (4) discharging and cooling the molten mixture before reducing it to 1 millimeter particles. The second step comprises (5) adding the resultant composite particles from the first step with a chemical initiator and additional base resin and toner additives, to a melt mixing device; (6) melting the resin component, thereby forming a polymer melt, and dispersing the initiator in a melt mixing device; (7) initiating crosslinking of the base resin, preferably with a chemical initiator and increased reaction temperature, and retaining the polymer melt in the melt mixing devices for a sufficient residence time that partial crosslinking of the base resin may be achieved; (8) optionally adding additional toner additives, if needed; (9) optionally devolatilizing the melt to remove any effluent volatiles; and (10) discharging the molten mixture to a cooling device.

In embodiments, the process of the present invention comprises the steps of: (1) dry blending a pigment and optionally toner additives with base resin; (2) feeding the resulting blend to an extruder; (3) melting the base resin and dispersing the pigment and optional additives; (4) discharging and cooling the molten mixture before reducing it to 1 millimeter particles in size diameter; (5) feeding the resultant composite particles with a chemical initiator, additional base resin and toner additives to an extruder; (6) melting the resin component, thereby forming a polymer melt, and dispersing the initiator at low temperature to enable a uniform dispersion of the initiator in the base resin before the onset of crosslinking; (7) initiating crosslinking of the base resin with the initiator by raising the melt temperature and controlling it along the extruder channel, and keeping the polymer melt in the extruder for a sufficient residence time at a given temperature such that the required amount of crosslinking is achieved; (8) optionally feeding additional toner additives, if needed, at a downstream port of the extruder; (9) optionally devolatilizing the melt to remove any effluent volatiles; and (10) pumping the crosslinked resin melt through a die to a cooling device and a pelletizer.

In the process of the present invention, the fabrication of the crosslinked toner may be carried out in a melt mixing device, such as an extruder described in U.S. Pat. No. 4,894,308, the disclosure of which is hereby totally incorporated herein by reference. Generally, any high shear, high temperature melt mixing device suitable for processing polymer melts may be employed, provided that the objectives of the present invention are achieved. Examples of continuous melt mixing devices include single screw extruders or twin screw extruders, continuous internal mixers, gear extruders, disc extruders and roll mill extruders. Examples of batch internal melt mixing devices include Banbury mixers, Brabender mixers and Haake mixers.

One suitable type of extruder is the fully intermeshing corotating twin screw extruder, such as, for example, the ZSK-30 twin screw extruder, available from Werner & Pfleiderer Corporation, Ramsey, New Jersey, U.S.A., which has a screw diameter of 30.7 millimeters and a length-to-diameter (L/D) ratio of 37. The extruder can melt the base resin, mix the pigment into the base resin melt, and provide high shear stress to disperse pigment agglomerates, and embodiments to coat the pigment. The extruder can also provide high temperature and adequate residence time for the crosslinking reaction to be carried out and control the reaction temperature via appropriate temperature control along the extruder channel. Following compounding or reaction, the extruder can optionally devolatilize the melt to remove any effluent volatiles, and pump the molten mixture through a die such as, for example, a strand die to a pelletizer. For chemical reactions in highly viscous materials, reactive extrusion is particularly efficient, and is advantageous because it requires no solvents, and thus is easily environmentally controlled. It is also advantageous because it permits a high degree of initial mixing of base resin and initiator to take place, and provides an environment wherein a controlled high temperature (adjustable along the length of the extruder) is available so that a very quick reaction can occur. Further, such processes enable a reaction continuously, and thus the reaction is not limited by the disadvantages of a batch process, wherein the reaction must be repeatedly stopped so that the reaction products may be removed and the apparatus cleaned and prepared for another similar reaction. When the desired amount of crosslinking is achieved, the reaction products can be quickly removed from the reaction chamber.

For a better understanding of the present invention, a typical reactive extrusion apparatus suitable for the process of the present invention is illustrated in FIG. 1. FIG. 1 illustrates a twin screw extrusion device 1 containing a drive motor 2, a gear reducer 3, a drive belt 4, an extruder barrel 5, a screw 6, a screw channel 7, an upstream supply port or hopper 8, a downstream supply port 9, a downstream devolatilizer 10, a heater 11, a thermocouple 12, a die or head pressure generator 13, and a pelletizer 14. The barrel 5 consists of modular barrel sections, each separately heated with heater 11 and temperature controlled by thermocouple 12 and a remote temperature controller. With modular barrel sections, it is possible to locate feed ports and devolatilizing ports at required locations, and to provide segregated temperature control along the screw channel 7. The screw 6 is also modular, enabling the screw to be configured with modular screw elements and kneading elements having the appropriate lengths, pitch angles, etc. in such a way as to provide optimum conveying, mixing, reaction, devolatilizing and pumping conditions.

In operation, the components to be melt mixed, for example the base resin and pigment mixture after dry blending, enter the extrusion apparatus from the first upstream supply port 8. The particles can be fed to the first upstream supply port 8 by starve feeding, gravity feeding, volumetric feeding, loss-in-weight feeding, or other known feeding methods. Toner additives can be blended with the base resin and pigment and fed to the first upstream supply port together, or they can be fed separately to the first upstream supply port or the second downstream supply port 9 by similar feeding methods. After the resin and pigment, and/or the additive have been fed into screw channel 7, the resin is melted and pigment and/or additive particles are dispersed into the molten resin as it is heated. Heating takes place from two sources: (1) external barrel heating from heaters 11, and (2) internal heating from viscous dissipation within the polymer melt itself. The rotational speed of the extruder screw preferably ranges from about 50 to about 500 revolutions per minute. At the end of screw channel 7, the base resin, pigment, and/or additive mixture is pumped in molten form through die 13, such as for example a strand die, to pelletizer 14 such as, for example, a water bath pelletizer, underwater granulator, etc. In the second reactive extrusion step, the base resin, pigment, and/or additive composite particles can be fed to the first upstream supply port by any of the feeding methods described before. Feeding of the chemical initiator to the extruder depends in part on the nature of the initiator. In one embodiment of the invention, especially if the initiator is a solid, the resin and pigment composite particles and initiator are preblended prior to being added to the extruder, and additional base resin and/or toner additives may be included in the preblend or added through either upstream supply port 8, downstream supply port 9, or both. In another embodiment, especially if the initiator is a liquid, the resin and pigment composite particles and initiator can preferably be added to the extruder separately through upstream supply port 8. This does not preclude other methods of adding materials to the extruder. After the resin and pigment, and the initiator have been fed into screw channel 7, the resin is melted and the initiator is dispersed into the molten resin as it is heated, but preferably still at a lower temperature than is needed for crosslinking. When the temperature of the molten resin and initiator reaches a critical point, onset of the crosslinking reaction takes place. It is preferable that the time required for completion of the crosslinking reaction not exceed the residence time in the screw channel 7. If needed, volatiles may be removed through downstream devolatilizer 10 by applying a vacuum. At the end of screw channel 7, the crosslinked resin, pigment, and additive mixture is pumped in molten form through die 13 to pelletizer 14.

With further reference to FIG. 1, the rotational speed of the screw 6 in each of the two steps can be of any suitable value provided that the objectives of the present invention are achieved. Generally, the rotational speed of screw 6 is from about 50 revolutions per minute to about 500 revolutions per minute. The barrel temperature, which is controlled by thermocouple 12 and generated in part by heaters 11, is from about 40° C. to about 250° C. The temperature range for mixing the base resin and pigment during the first extrusion step can be from about 50° to 100° C. above the melting temperature of the base resin in the upstream barrel zones where the base resin is being melted to slightly above the melting temperature in the downstream barrel zones where dispersion of pigment in the polymer melt takes place depending, for example, both on the characteristics of the resin and the extrusion equipment. For example, for an unsaturated polyester base resin, the temperature is preferably about 100° C. to about 200° C. in the upstream barrel zones. The die or head pressure generator 13 generates pressure from about 50 pounds per square inch to about 500 pounds per square inch. In one embodiment, the screw is allowed to rotate at about 300 revolutions per minute, the temperature along barrel 5 is maintained at about 70° C. in the first barrel section, 120° C. upstream, and 90° C. downstream, and the die pressure is about 50 pounds per square inch. In the second extrusion step, the temperature range for mixing the base resin, pigment composite and initiator in the upstream barrel zones is from about the melting temperature of the base resin to below the crosslinking onset temperature, and preferably within about 40° C. of the melting temperature of the base resin. For example, for an unsaturated polyester base resin the temperature is preferably about 90° C. to about 130° C. The temperature range for the crosslinking reaction in the downstream barrel zones is above the crosslinking onset temperature and the base resin melting temperature, preferably within about 150° C. of the base resin melting temperature. For example, for an unsaturated polyester base resin, the temperature is preferably about 90° C. to about 250° C. In one embodiment, the screw is allowed to rotate at about 100 revolutions per minute, the temperature along barrel 5 is maintained at about 70° C. in the first barrel section and 160° C. further downstream, and the die pressure is about 50 pounds per square inch.

When crosslinking in a batch internal melt mixing device, the residence time is preferably in the range of about 10 seconds to about 5 minutes. The rotational speed of a rotor in the device is preferably about 10 to about 500 revolutions per minute.

Thus, in a process embodiment of this invention, the base resin and pigment are fed to a melt mixing apparatus to produce a well dispersed composite. The composite containing the reactive base resin and pigment, and a chemical initiator are then fed to a reactive melt mixing apparatus, and crosslinking is carried out at high temperature and high shear to produce a toner precursor with crosslinked resin which enables the preparation of low fix temperature toners with good fusing latitude and vinyl offset properties.

Examples of the base resin selected for the process of this invention is a reactive polymer, preferably a linear reactive polymer such as, for example, linear unsaturated polyester. In preferred embodiments, the base resin has a degree of unsaturation of about 0.1 to about 30 mole percent, preferably about 5 to about 25 mole percent. In a preferred embodiment, the linear unsaturated polyester base resin is characterized by number-average molecular weight ($M_n$) as measured by gel permeation chromatography (GPC) in the range typically from 1,000 to about 20,000, and preferably from about 2,000 to about 5,000, and weight-average molecular weight ($M_w$) in the range typically from 2,000 to about 40,000, and preferably from about 4,000 to about 15,000. The molecular weight distribution ($M_w/M_n$) is in the range typically from about 1.5 to about 6, and preferably from about 2 to about 4. Onset glass transition temperature (Tg) as measured by differential scanning calorimetry (DSC) is in the range typically from 50° C. to about 70° C., and preferably from about 50° C. to about 60° C. Melt viscosity as measured with a mechanical spectrometer at 10 radians per second is from about 5,000 to about 200,000 poise, and preferably from about 20,000 to about 100,000 poise, at 100° C. and drops sharply with increasing temperature to from about 100 to about 5,000 poise, and preferably from about 400 to about 2,000 poise as temperature rises from 100° C. to 130° C.

Linear unsaturated polyesters selected as the base resin are comprised of low molecular weight condensation polymers which may be formed by the step-wise reactions between both saturated and unsaturated diacids (or anhydrides) and dihydric alcohols (glycols or diols). The resulting unsaturated polyesters are reactive (e.g., crosslinkable) on two fronts: (i) unsaturation sites (double bonds) along the polyester chain, and (ii) functional groups, such as carboxyl, hydroxy, and the like, amenable to acid-base reactions. Typical unsaturated polyesters useful for this invention are prepared by melt polycondensation or other polymerization processes using diacids and/or anhydrides and diols. Suitable diacids and anhydrides include, but are not limited to saturated diacids and/or anhydrides such as, for example, succinic acid, glutaric acid, adipic acid, pimelic acid, suberic acid, azelaic acid, sebacic acid, isophthalic acid, terephthalic acid, hexachloroendomethylene tetrahydrophthalic acid, phthalic anhydride, chlorendic anhydride, tetrahydrophthalic anhydride, hexahydrophthalic anhydride, endomethylene tetrahydrophthalic anhydride, tetrachlorophthalic anhydride, tetrabromophthalic anhydride, and the like, and mixtures thereof; and unsaturated diacids and/or anhydrides such as, for example, maleic acid, fumaric acid, chloromaleic acid, methacrylic acid, acrylic acid, itaconic acid, citraconic acid, mesaconic acid, maleic anhydride, and the like, and mixtures thereof. Suitable diols include but are not limited to, for example, propylene glycol, ethylene glycol, diethylene glycol, neopentyl glycol, dipropylene glycol, dibromoneopentyl glycol, propoxylated bisphenol A, 2,2,4-trimethylpentane-1,3-diol, tetrabromo bisphenol dipropoxy ether, 1,4-butanediol, and the like, and mixtures thereof, soluble in good solvents such as, for example, tetrahydrofuran, toluene and the like.

Preferred linear unsaturated polyester base resins are prepared from diacids and/or anhydrides such as, for example maleic anhydride, fumaric acid, and the like, and mixtures thereof, and diols such as, for example, propoxylated bisphenol A, propylene glycol, and the like, and mixtures thereof. A particularly preferred polyester is poly(propoxylated bisphenol A fumarate).

Substantially any suitable unsaturated polyester can be used in the process of the invention, including unsaturated polyesters known for use in toner resins, and including unsaturated polyesters whose properties previously made them undesirable or unsuitable for use as toner resins (but which adverse properties are eliminated or reduced by crosslinking them by the process of the present invention).

Various suitable colorants in effective amounts, such as for example from 1 to about 20, and preferably from 2 to about 10 weight percent can be employed in toners and processes of the present invention, including suitable colored pigments, dyes, and mixtures thereof, including carbon black, such as REGAL 330® carbon black (Cabot), Acetylene Black, Lamp Black, Aniline Black, Chrome Yellow, Zinc Yellow, Sicofast Yellow, Luna Yellow, Novaperm Yellow, Chrome Orange, Bayplast Orange, Cadmium Red, LITHOL SCARLET™, Hostaperm Red, FANAL PINK™, Hostaperm Pink, Lithol Red, Rhodamine Lake B, Brilliant Carmine, Heliogen Blue, Hostaperm Blue, Neopan Blue, PV FAST BLUE™, Cinquassi Green, Hostaperm Green, titanium dioxide, cobalt, nickel, iron powder, SICOPUR 4068 FF™, and iron oxides, such as MAPICO BLACK™ (Columbia), NP608™ and NP604™ (Northern Pigment), BAYFERROX 8610™ (Bayer), MO8699™ (Mobay), TMB-100™ (Magnox), mixtures thereof, and the like.

Any appropriate initiation technique for crosslinking can be used in the process of the invention. Chemical initiators in effective amounts, such as, for example, organic peroxides or azo-compounds, are preferred for this process. Suitable organic peroxides include diacyl peroxides such as, for example, decanoyl peroxide, lauroyl peroxide and benzoyl peroxide, ketone peroxides such as, for example, cyclohexanone peroxide and methyl ethyl ketone; alkyl peroxyesters such as, for example, t-butyl peroxy neodecanoate, 2,5-dimethyl 2,5-di (2-ethyl hexanoyl peroxy) hexane, t-amyl peroxy 2-ethyl hexanoate, t-butyl peroxy 2-ethyl hexanoate, t-butyl peroxy acetate, t-amyl peroxy acetate, t-butyl peroxy benzoate, t-amyl peroxy benzoate, oo-t-butyl o-isopropyl mono peroxy carbonate, 2,5-dimethyl 2,5-di (benzoyl peroxy) hexane, oo-t-butyl o-(2-ethyl hexyl) mono peroxy carbonate, and oo-t-amyl o-(2-ethyl hexyl) mono peroxy carbonate; alkyl peroxides such as, for example, dicumyl peroxide, 2,5-dimethyl 2,5-di (t-butyl peroxy) hexane, t-butyl cumyl peroxide, α-α-bis (t-butyl peroxy) diisopropyl benzene, di-tobutyl peroxide and 2,5-dimethyl 2,5-di (t-butyl peroxy) hexane-3; alkyl hydroperoxides such as, for example, 2,5-dihydro peroxy 2,5-dimethyl hexane, cumene hydroperoxide, t-butyl hydroperoxide and t-amyl hydroperoxide; and alkyl peroxyketals such as, for example, n-butyl 4,4-di (t-butyl peroxy) valerate, 1,1-di (t-butyl peroxy) 3,3,5-trimethyl cyclohexane, 1,1-di (t-butyl peroxy) cyclohexane, 1,1-di (t-amyl peroxy) cyclohexane, 2,2-di (t-butyl peroxy) butane, ethyl 3,3-di (tbutyl peroxy) butyrate and ethyl 3,3-di (t-amyl peroxy) butyrate. Suitable azo-compounds include azobis-isobutyronitrile, 2,2'-azobis (isobutyronitrile), 2,2'-azobis (2,4-dimethyl valeronitrile), 2,2'-azobis (methyl butyronitrile), 1,1'-azobis (cyano cyclohexane), and other similar known compounds.

In the crosslinking reaction, which occurs in the process of the present invention at high temperature and high shear, the chemical initiator, such as for example benzoyl peroxide, disassociates in the presence of pigment to form free radicals which attack the linear unsaturated base resin polymer chains (e.g., at double bonds) to form polymeric radicals. Crosslinking occurs in the presence of pigment as these polymeric radicals react with other unsaturated chains or other polymeric radicals many times, forming very high molecular weight gel particles with high crosslinking density containing pigment and other needed toner additives.

The crosslinking, which occurs in the process of the present invention, is characterized by at least one reactive site, that is one unsaturation, within a polymer chain reacting substantially directly with, for example, no intervening monomers, with at least one reactive site within a second polymer chain, and by this reaction occurring repeatedly to form a series of crosslinked units. This manner of crosslinking between chains will produce a large, high molecular weight molecule, ultimately forming a gel. The polymer crosslinking reaction may occur by a number of mechanisms. For example, when an exemplary propoxylated bisphenol A fumarate unsaturated polymer undergoes a crosslinking reaction with a chemical crosslinking initiator, such as, for example, benzoyl peroxide, free radicals produced by the chemical initiator may attack an unsaturation site, that is double bonds on the polymer to form polymer radicals. Crosslinking occurs as these polymeric radicals react with other unsaturated chains or other polymeric radicals many times forming very high molecular weight gel particles with high crosslinking density. By a second mechanism, crosslinking may occur between chains of the same exemplary molecule where the free radicals formed from a chemical crosslinking initiator attack the carbon of the propoxy group by hydrogen abstraction of a tertiary hydrogen to form polymer radicals.

A small concentration of initiator is adequate to carry out the crosslinking, usually in the range from about 0.01 to about 10 percent by weight of initiator in the base resin, and preferably in the range of from about 0.1 to about 4 percent by weight of initiator in the base resin. By carrying out the crosslinking in the melt state at high temperature and high shear in a melt mixing device, such as an extruder, the gel particles formed during crosslinking are kept small (i.e. less than about 0.3 micron, and preferably about 0.005 to about 0.3 micron in average volume particle diameter as determined by scanning electron microscopy and transmission electron microscopy), and their size does not grow with increasing degree of crosslinking. Also, the high shear enables the microgel particles to be substantially uniformly dispersed in the toner melt.

An advantage of using a chemical initiator as the crosslinking agent is that by utilizing low concentrations of initiator (for example, less than 10 percent by weight and often less than 4 percent by weight) and carrying out the crosslinking at high temperature, little or no unreacted initiator remains in the product, and therefore, the residual contaminants produced in the crosslinking reaction are minimal.

Thus, the crosslinked toner produced in the process of this invention is a clean and safe polymer mixture comprising crosslinked gel particles and a noncrosslinked or linear portion, but substantially no sol. The gel content of the crosslinked toner ranges from about 0.001 to about 50 percent by weight of total polymer in the toner, and preferably from about 0.1 to about 40 percent by weight, wherein the gel content is defined as follows:

$$\text{Gel Content} = \frac{\text{Total Polymer Weight} - \text{Weight of Soluble Polymer}}{\text{Total Polymer Weight}} \times 100\%$$

There is substantially no crosslinked polymer which is not gel, that is low crosslink density polymer or sol, as would be obtained in conventional crosslinking processes such as, for example, polycondensation, bulk, solution, suspension, emulsion and suspension polymerization processes.

The crosslinked portions of resin in the crosslinked toner consist essentially of very high molecular weight microgel particles with high density crosslinking (as measured by gel content), and which are pigmented and are not soluble in substantially any solvents such as, for example, tetrahydrofuran, toluene and the like. The microgel particles are highly crosslinked polymers with a short crosslink distance of zero or a maximum of one atom such as, for example, oxygen.

The linear portions of resin in the crosslinked toner have substantially the same number average molecular weight ($M_n$), weight-average molecular weight ($M_w$), molecular weight distribution ($M_w/M_n$), onset glass transition temperature (Tg) and melt viscosity as the base resin. Thus, embodiments of the entire crosslinked resin have an onset glass transition temperature of from about 50° C. to about 70° C., and preferably from about 50° C. to about 60° C., and a melt viscosity of from about 5,000 to about 200,000 poise, and preferably from about 20,000 to about 100,000 poise, at 100° C. and from about 10 to about 20,000 poise at 160° C.

In the preferred embodiment of crosslinked toner containing a crosslinked unsaturated polyester resin prepared by the process of this invention, the crosslinked resin enables the preparation of toners with minimum fix temperatures in the range of about 100° C. to about 200° C., preferably about 100° C. to about 160° C., and more preferably about 110° C. to about 140° C. Also, these low fix temperature toners have fusing latitudes ranging from about 10° C. to about 120° C., preferably more than about 20° C., and more preferably more than about 30° C. The process of the invention can produce toner resins, and thus toners with minimized or substantially no vinyl offset.

The crosslinked toners obtained have the important rheological property of allowing a toner prepared therefrom to possess low fix temperature and high offset temperature. The low fix temperature is a function of the molecular weight and molecular weight distribution of the linear portion, and is believed not to be significantly affected by the amount of microgel or degree of crosslinking in the resin. The hot offset temperature is increased with the presence of microgel particles which impart elasticity to the resin. With higher degree of crosslinking or gel content, the hot offset temperature increases. This is reflected in divergence of the viscosity curves at high temperature such as, for example, at 160° C. As the degree of crosslinking or gel content increases, the low temperature melt viscosity does not change significantly while the high temperature melt viscosity goes up. In an exemplary embodiment, the hot offset temperature can increase approximately 30 percent. Again, this can be achieved by crosslinking in the melt state at high temperature and high shear such as, for example, in an extruder resulting in the formation of microgel alone, distributed substantially uniformly throughout the linear portion, and no intermediates which are crosslinked polymers with low crosslinking density (sol).

In addition to rendering a unique rheological property to the toner not attainable to date in conventional crosslinking processes the reactive melt mixing process has several other important advantages in the context of the present invention.

By choosing the type and molecular weight properties of the base resin, the minimum fix temperature can be easily manipulated. The hot offset temperature can be easily manipulated by the gel content in the crosslinked resin, which can be controlled by the amount of initiator fed to the extruder and/or regulating the extruder process conditions such as, for example, feed rate, screw rotational speed, barrel temperature profile, and screw configuration and length. Thus, it is possible to produce a series of resins and thus toners with the same MFT, but with different fusing latitudes. Crosslinking by the use of chemical initiators in the extruder is one of the cleanest means of modifying resin since very low concentrations of initiators are used, often less than 4 percent by weight, and the residual contaminants of the crosslinking reaction are minimal. Crosslinking in the presence of a pigment further provides a toner with uniform structure and properties. The elimination of unpigmented gel particles will prevent the loss of these particles through classification, thus maintaining the gel level in toner at desirable level to achieve HOT performance. Toner with uniform pigment and additive dispersion will also charge more uniformly to provide excellent development and images with high resolution with substantially no background deposits.

The resins are generally present in the toner in an amount of from about 40 to about 98 percent by weight, and more preferably from about 70 to about 98 percent by weight, although they may be present in greater or lesser amounts, provided that the objectives of the invention are achieved. For example, toner resin produced by the process of the invention can be subsequently melt blended or otherwise mixed with a colorant, charge carrier additives, surfactants, emulsifiers, pigment dispersants, flow additives, and the like. The resultant product can then be pulverized by known methods, such as milling, to form toner particles. The toner particles preferably have an average volume particle diameter of about 5 to about 25, more preferably about 10 to about 20 microns.

Various suitable colorants can be employed in toners of the invention, including suitable colored pigments, dyes, and mixtures thereof including carbon black, such as REGAL 330® carbon black (Cabot), Acetylene Black, Lamp Black, Aniline Black, Chrome Yellow, Zinc Yellow, Sicofast Yellow, Luna Yellow, Novaperm Yellow, Chrome Orange, Bayplast Orange, Cadmium Red, LITHOL SCARLET™, Hostaperm Red, Fanal Pink, Hostaperm Pink, Lithol Red, Rhodamine Lake B, Brilliant Carmine, Heliogen Blue, Hostaperm Blue, Neopan Blue, PV FAST BLUE™, Cinquassi Green, Hostaperm Green, titanium dioxide, cobalt, nickel, iron powder, SICOPUR 4068 FF™; and iron oxides such as MAPICO BLACK™ (Columbia), NP608™ and NP604™ (Northern Pigment), BAYFERROX 8610™ (Bayer), MO8699™ (Mobay), TMB-100™ (Magnox), mixtures thereof, and the like.

The colorant, preferably carbon black, cyan, magenta and/or yellow colorant, is incorporated in an amount sufficient to impart the desired color to the toner. In general, pigment or dye is employed in an amount ranging from about 2 to about 60 percent by weight, and preferably from about 2 to about 7 percent by weight for color toner and about 5 to about 60 percent by weight for black toner. In the first melt mixing step, the amount of pigment employed can be either the same amount in the final toner formulation or greater. When a color concentrate is prepared in the first step, additional base resin is preferably added in the second step to decrease the pigment concentration to the desirable level in the toner.

Various known suitable effective positive or negative charge enhancing additives can be selected for incorporation into the toner compositions produced by the present invention, preferably in an amount of about 0.1 to about 10, more preferably about 1 to about 3 percent by weight. Examples include quaternary ammonium compounds inclusive of alkyl pyridinium halides; alkyl pyridinium compounds, reference U.S. Pat. No. 4,298,672, the disclosure of which is totally incorporated herein by reference; organic sulfate and sulfonate compositions, U.S. Pat. No. 4,338,390, the disclosure of which is totally incorporated herein by reference; cetyl pyridinium tetrafluoroborates; distearyl dimethyl ammonium methyl sulfate; aluminum salts such as BONTRON E84™ or E88™ (Hodogaya Chemical); and the like.

Additionally, other internal and/or external additives may be added in known amounts for their known functions.

The resulting toner particles optionally can be formulated into a developer composition by mixing with carrier particles. Illustrative examples of carrier particles that can be selected for mixing with the toner composition prepared in accordance with the present invention include those particles that are capable of triboelectrically obtaining a charge of opposite polarity to that of the toner particles. Accordingly, in one embodiment the carrier particles may be selected so as to be of a negative polarity in order that the toner particles, which are positively charged, will adhere to and surround the carrier particles. Illustrative examples of such carrier particles include granular zircon, granular silicon, glass, steel, nickel, iron ferrites, silicon dioxide, and the like. Additionally, there can be selected as carrier particles nickel berry carriers as disclosed in U.S. Pat. No. 3,847,604, the disclosure of which is totally incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are totally incorporated herein by reference.

The selected carrier particles can be used with or without a coating, the coating generally being comprised of fluoropolymers, such as polyvinylidene fluoride resins, terpolymers of styrene, methyl methacrylate, a silane, such as triethoxy silane, tetrafluoroethylenes, other known coatings and the like.

The diameter of the carrier particles is generally from about 50 microns to about 1,000 microns, preferably about 200 microns, thus allowing these particles to possess sufficient density and inertia to avoid adherence to the electrostatic images during the development process. The carrier particles can be mixed with the toner particles in various suitable combinations. Best results are obtained when about 1 part carrier to about 10 parts to about 200 parts by weight of toner are mixed.

Toners produced by the process of the invention can be used in known electrostatographic imaging methods, although the fusing energy requirements of some of those methods can be reduced in view of the advantageous fusing properties of the subject toners as discussed herein. Thus, for example, the toners or developers can be charged, for example, triboelectrically, and applied to an oppositely charged latent image on an imaging member such as a photoreceptor or ionographic receiver. The resultant toner image can then be transferred, either directly or via an intermediate transport member, to a support such as paper or a transparency sheet. The toner image can then be fused to the support by application of heat and/or pressure, for example with a heated fuser roll at a temperature lower than 200° C., preferably lower than 160° C., more preferably lower than 140° C., and more preferably about 110° C.

The invention will further be illustrated in the following, nonlimiting Examples, it being understood that these Examples are intended to be illustrative only and that the invention is not intended to be limited to the materials, conditions, process parameters and the like recited herein. Parts and percentages are by weight unless otherwise indicated.

EXAMPLE I

A xerographic toner was prepared according to the process of this invention by melt mixing a linear unsaturated propoxylated bisphenol A fumarate polyester having a $M_n$ of about 4,000, a $M_w$ of about 10,300, a $M_w/M_n$ of about 2.58 as measured by GPC, an onset Tg of about 55° C. as measured by DSC, and a melt viscosity of about 29,000 poise at 100° C., and about 750 poise at 130° C. as measured at 10 radians per second, with a REGAL 330® carbon black and subsequently with benzoyl peroxide as follows.

The unsaturated polyester resin in an amount of 94 parts, and REGAL 330® carbon black in the amount of 6 parts, were blended in a rotary tumble blender at 22 revolutions per minute for 30 minutes. The resulting dry mixture was then fed into the upstream supply port located at the first barrel section of a Werner & Pfleiderer twin screw extruder, Model ZSK-30, at 10 pounds per hour using a loss-in-weight feeder. The temperature of the 12 barrel sections and a die head of the ZSK-30 extruder was kept at a profile of 50/70/70/100/100/100/100/100/100/100/100/100/100° C. The screw rotational speed was kept at 200 revolutions per minute. The molten extrudate, upon exiting from the strand die, was cooled and solidified in a water tank, and subsequently cut into pellets by a pelletizer equipped with revolving knives. The pellets were then pulverized in a mechanical impact mill to particles about 0.85 millimeter in size diameter. The particles, in the amount of 97 parts, were then blended with 3 parts of a benzoyl peroxide initiator (Atochem L-78) using a rotary tumble blender at 22 revolutions per minute for 30 minutes. The resulting dry mixture was then fed into the upstream supply port of the ZSK-30 extruder at 10 pounds per hour using a loss-in-weight feeder. The temperature profile was kept at 50/70/70/140/140/140/140/120/120/120/110/110/110° C. and the screw rotational speed was kept at 100 revolutions per minute. The molten extrudate was cooled and pelletized as described above. The pellets were then pulverized in several steps involving the use of a mechanical impact mill and a fluid energy mill, and subsequently classified to obtain toner particles with a volume average size of about 7.2 microns and a geometric standard deviation of about 1.40. Measurement of gel content showed that 28.9 percent of the base resin was crosslinked. The crosslinked resin had a melt index of 40.0 grams/10 minutes at 117° C. and 16.6 kilograms load.

Figure 3:
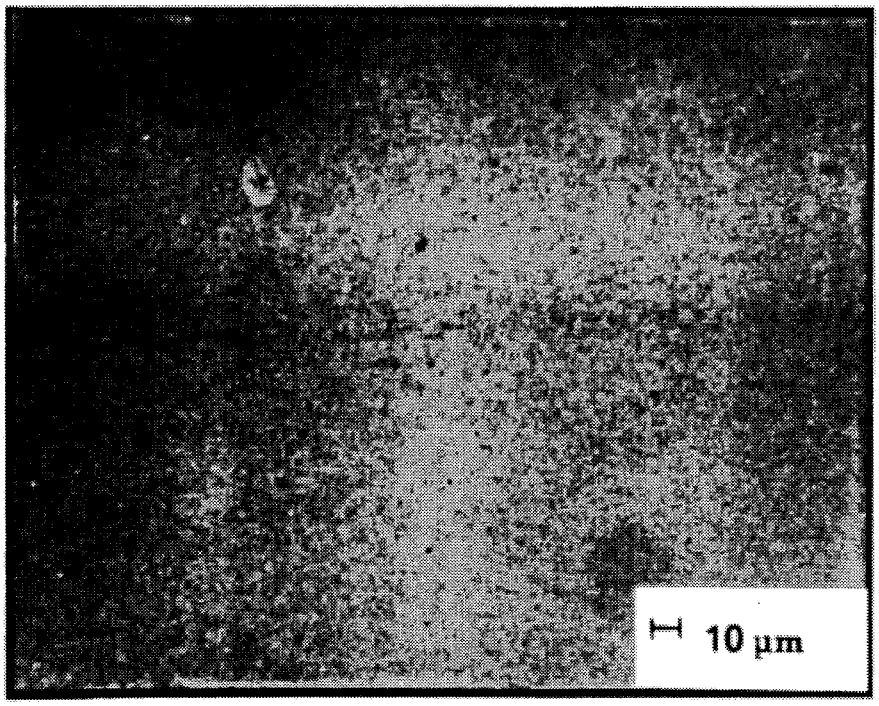
FIG. 3 is a photograph of a toner precursor material taken also with an optical microscope. The material was prepared by process of this invention. The base resin was mixed with pigment, carbon black in this case, first using a melt mixing device. The mixture was then melt mixed with an initiator to crosslink the base resin using again a melt mixing device. It was clear that pigment particles dispersed evenly throughout the sample and there was no unpigmented gel domains.

Examination of thin section of extruded pellet after the second extrusion step using an optical microscope showed a uniform carbon black dispersion and an absence of unpigmented gel domains as illustrated in FIG. 3. The toner was evaluated for fixing, blocking, and vinyl offset performance. Results showed that the minimum fix temperature was about 124° C., and the hot offset temperature was about 170° providing a fusing latitude of about 46° C. Also, the toner had excellent blocking performance, about 52° C. as measured by DSC, and evidenced no apparent vinyl offset after a developed copy was retained in contact with a polyvinyl chloride sheet for 24 hours at an elevated temperature of 50° C.

EXAMPLE II

A xerographic toner was prepared following the procedure as described in Example I by melt mixing in the ZSK-30 extruder, in the first step, 94 parts of a linear propoxylated bisphenol A fumarate unsaturated polyester base resin with properties as described in Example I with 6 parts of a REGAL 330® carbon black. In the second reactive melt mixing step, 96.7 parts of the composite particles obtained after the first extrusion step was mixed with 3.3 parts of benzoyl peroxide in the extruder at a temperature profile of 50/70/70/150/150/150/150/130/130/130/130/130/130° C., a screw rotational speed of 100 revolutions per minute, and a feed rate of 10 pounds per hour. After pulverizing and classification, a toner with a volume average size of about 7.1 microns and a geometric standard deviation of about 1.36 was obtained. Measurement of gel content showed that 33.7 percent of the base resin was crosslinked. The crosslinked resin had a melt index of 23.4 grams/10 minutes at 117° C. and 16.6 kilograms load.

Examination of a thin section of extruded pellet after the second extrusion step using an optical microscope showed a uniform carbon black dispersion and an absence of unpigmented gel domains. The toner was then evaluated for fixing, blocking, and vinyl offset performance. Results showed that the minimum fix temperature was about 129° C., and the fusing latitude was about 46° C. Also, the toner had excellent blocking performance, about 52° C. as measured by DSC, and evidenced no vinyl offset after accomplishing similar measurements as described in Example I.

EXAMPLE III

A xerographic toner was prepared by melt mixing 94 parts of the linear unsaturated polyester of Example I with 6 parts of a REGAL 330® carbon black in a batch mixer, Haake Buchler HBI System 90 Torque Rheometer. The blend was mixed at a mixer temperature of 100° C. and a rotor rotational speed of 100 revolutions per minute for a duration of 30 minutes. After cooling down the solidified mixture was ground and then dry blended with 3 parts benzoyl peroxide. The mixture was added to the batch mixer and the second reactive melt mixing step was carried out at 160° C. and 100 revolutions per minute for 12 minutes. After mixing was completed, the molten mixture was allowed to solidify. Measurement of gel content showed that 29.4 percent of the base resin was crosslinked. Examination of a thin section of extruded pellet after the second extrusion step using an optical microscope showed a uniform carbon black dispersion and an absence of unpigmented gel domains.

COMPARATIVE EXAMPLE 1

A crosslinked resin was prepared by mixing 98.3 parts of the linear unsaturated polyester of Example I with 1.7 parts benzoyl peroxide initiator according to the following procedure, reference for example U.S. Pat. No. 5,227,460.

The unsaturated polyester resin and benzoyl peroxide initiator were blended in a rotary tumble blender at 22 revolutions per minute for 30 minutes. The resulting dry mixture was then fed into the upstream supply port located at the first barrel section of the ZSK-30 extruder at 10 pounds per hour using a loss-in-weight feeder. The temperature of the 12 barrel sections plus a die head was kept at a profile of 50/70/70/100/100/100/120/140/140/140/140/140/120° C. The screw rotational speed was kept at 100 revolutions per minute. The molten extrudate, upon exiting from the strand die, was cooled and solidified in a water tank and subsequently cut into pellets by a pelletizer equipped with revolving knives. The pellets were then pulverized in a mechanical impact mill to obtain particles about 0.85 millimeter in size. Measurement of gel content showed that 27.4 percent of the base resin was crosslinked. The crosslinked resin had a melt index of 19.3 grams/10 minutes at 117° C. and 16.6 kilograms load.

Figure 2:
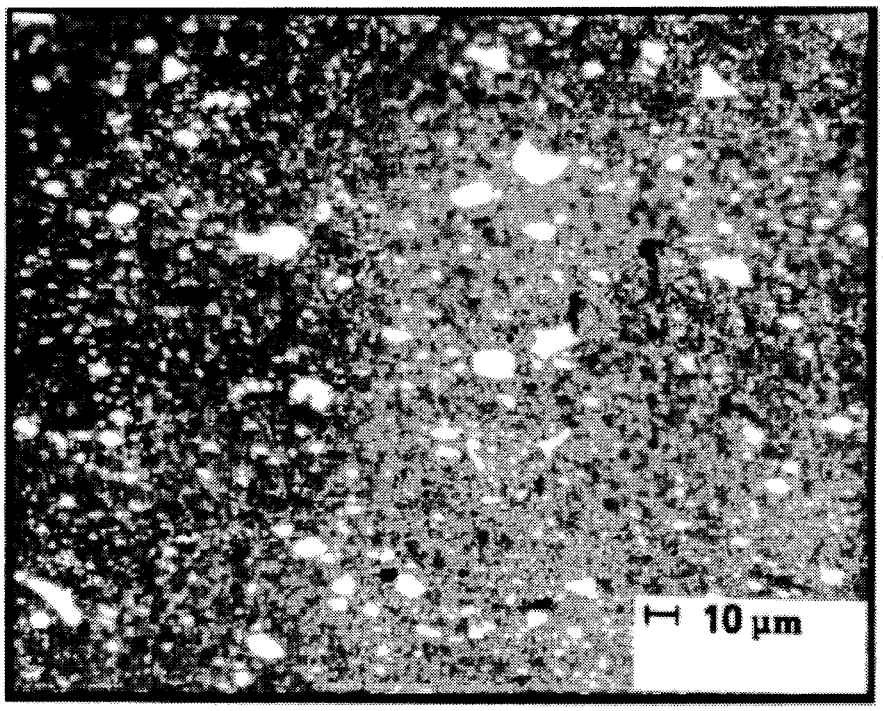
FIG. 2 is a photograph of a toner precursor material taken with an optical microscope. The material was prepared by procedures similar to those described in the prior art mentioned here. The base resin was crosslinked in a reactive blending process using a melt mixing device. The crosslinked resin was subsequently melt mixed with pigment, carbon black in this sample, again using a melt mixing device. The large gel domains with no pigment particles inside were clearly detectable as white areas.

A toner was then prepared by melt mixing 94 parts of the partially crosslinked polyester and 6 parts of REGAL 330® carbon black according to the following procedure. The partially crosslinked polyester and carbon black were blended in a rotary tumble blender at 22 revolutions per minute for 30 minutes. The resulting dry mixture was then fed into the upstream supply port located at the first barrel section of the ZSK-30 extruder at 10 pounds per hour using a loss-in-weight feeder. The temperature of the 12 barrel sections plus a die head was kept at a profile of 50/70/70/140/140/140/140/140/140/140/140/140/140° C. The screw rotational speed was kept at 140 revolutions per minute. The molten extrudate was cooled, solidified and pelletized as before. The pellets were then pulverized in several steps to obtain toner particles with a volume average size of about 11 microns and a geometric standard deviation of 1.3. Measurement of gel content showed that 14.4 percent of the resin in the toner was crosslinked. Measurement of melt flow index showed that the toner had a melt index of 29.8 grams/10 minutes at 117° C. and 16.6 kilograms load. It was speculated that the additional melt mixing step in the extruder had caused some of the gel particles to break down. This resulted in a toner with different rheological properties. Examination of a thin section of extruded pellet after the second extrusion step using an optical microscope showed the presence of a number of unpigmented gel domains, 10 to 20 microns in average volume diameter in some instances, as illustrated in FIG. 2.

COMPARATIVE EXAMPLE 2

One hundred (100) parts of the linear unsaturated polyester with properties of Example I were blended with 1.63 parts of benzoyl peroxide and 6.38 parts of carbon black REGAL 330® in a rotary tumble blender at 22 revolutions per minute for 30 minutes. The resulting dry mixture was then fed into the upstream supply port of the ZSK-30 extruder. A temperature profile of 50/70/70/190/190/190/130/130/130/130/130/130/130° C., a feed rate of 10 pounds per hour, and a screw rotational speed of 100 revolutions per minute were used to melt mix the three-component mixture. The molten extrudate had very low viscosity. Melt flow index measurement showed a melt index greater than 300 grams/10 minutes at 117° C. and 16.6 kilogram load. The gel content measurement showed that the base resin was not crosslinked. It is believed, while not being desired to be limited by theory, that the carbon black became an inhibitor for free radical after initiation, and the presence of carbon black during the benzoyl peroxide initiation had prevented the crosslinking reaction of the base resin from taking place. This Example demonstrates the importance of passivating carbon black before initiating crosslinking reaction, reference the invention Examples.

Other embodiments and modifications of the present invention may occur to those skilled in the art subsequent to a review of the information presented herein; these embodiments and modifications, as well as equivalents thereof, are also included within the scope of this invention.

What is claimed is:

1. A process for the preparation of toner compositions consisting of (a) preparing a polymer composite consisting essentially of a reactive linear unsaturated polyester base resin and pigment by melting the base resin, and enabling dispersing of said pigment in said resin; subsequently cooling; and (b) melting by heating and shearing the resultant composite of (a) with additional base resin and free radical initiator, thereby forming a polymer composite melt of resin, initiator, and pigment, and crosslinking the resin component to form a crosslinked toner resin with substantially no unpigmented gel domains, wherein said pigment is carbon black, wherein the blend of base resin and pigment in (a) is subjected to melt mixing during said melting of said base resin, and where in the pigment is dispersed in and wetted by said base resin in said polymer composite.

2. A process in accordance with claim 1 wherein the melt mixing is accomplished in a batch melt mixing device or a continuous melt mixing device.

3. A process in accordance with claim 1 wherein the initiator is a chemical initiator and functions as a crosslinking agent; and wherein there is partial crosslinking of said resin of from about 20 to about 75 weight percent.

4. A process in accordance with claim 1 comprising mixing a chemical initiator into said polymer composite melt of (a) at a temperature lower than the onset of crosslinking temperature, thereby forming a uniform dispersion of the chemical initiator in said composite melt prior to onset of crosslinking of the resin component in the composite melt.

5. A process in accordance with claim 4 wherein the mixing is accomplished in a batch melt mixing device or a continuous melt mixing device.

6. A process in accordance with claim 4 further comprising a step of initiating crosslinking of the resin component in the composite melt with said chemical initiator by increasing the temperature of said composite melt of (a) above the onset of crosslinking temperature, and controlling the temperature of crosslinking reaction.

7. A process in accordance with claim 4 further comprising the step of initiating crosslinking of the resin component in the composite melt of (a) with said chemical initiator by raising the temperature of said composite melt above the onset of crosslinking temperature and within 150° C. of the base resin melting temperature, and controlling the temperature of said composite melt during said crosslinking.

8. A process in accordance with claim 1 comprising allowing said crosslinking reaction to be accomplished to completion.

9. A process in accordance with claim 1 wherein said additional base blend resin is a linear unsaturated resin.

10. A process in accordance with claim 1 wherein said additional base resin of (b) is a linear unsaturated polyester resin.

11. A process in accordance with claim 10 wherein said linear unsaturated polyester resin possesses a number-average molecular weight ($M_n$) as measured by gel permeation chromatography (GPC) in the range of from about 1,000 to about 20,000, a weight-average molecular weight ($M_w$) in the range of from about 2,000 to about 40,000, a molecular weight distribution ($M_w/M_n$) in the range of from about 1.5 to about 6, an onset glass transition temperature ($T_g$) as measured by differential scanning calorimetry in the range of from about 50° C. to about 70° C., and a melt viscosity as measured with a mechanical spectrometer at 10 radians per second of from about 5,000 to about 200,000 poise at 100° C., said melt viscosity dropping with increasing temperature to from about 100 to about 5,000 poise at 130° C.

12. A process in accordance with claim 10 wherein said linear unsaturated polyester resin is prepared from (a) diacids or anhydrides selected from the group consisting of succinic acid, glutaric acid, adipic acid, pimelic acid, suberic acid, azelaic acid, sebacic acid, isophthalic acid, terephthalic acid, hexachloroendomethylene tetrahydrophthalic acid, phthalic anhydride, chlorendic anhydride, tetrahydrophthalic anhydride, hexahydrophthalic anhydride, endomethylene tetrahydrophthalic anhydride, tetrachlorophthalic anhydride, tetrabromophthalic anhydride, maleic acid, fumaric acid, chloromaleic acid, methacrylic acid, acrylic acid, itaconic acid, citraconic acid, mesaconic acid, maleic anhydride, and mixtures thereof; and (b) diols selected from the group consisting of propylene glycol, ethylene glycol, diethylene glycol, neopentyl glycol, dipropylene glycol, dibromoneopentyl glycol, propoxylated bisphenol-A, 2,2,4-trimethylpentane-1,3-diol, tetrabromobisphenol dipropoxy ether, 1,4-butanediol, and mixtures thereof.

13. A process in accordance with claim 10 wherein said linear unsaturated polyester resin is propoxylated bisphenol A fumarate.

14. A process in accordance with claim 1 wherein said crosslinking is initiated by a chemical initiator selected from the group consisting of organic peroxides and azo compounds.

15. A process in accordance with claim 14 wherein said chemical initiator amount in said composite is in the range of from about 0.01 to about 10 percent by weight of initiator in the base resin.

16. A process in accordance with claim 1 wherein the melt mixing is accomplished in an extruder.

17. A process in accordance with claim 16 wherein there is selected an extrusion device for preparing said polymer composite of reactive base resin and pigment of (a), and wherein the temperature range for mixing the base resin and pigment is from about 50° to 100° C. above the melting temperature of the base resin in the upstream barrel zones of said extrusion device to below the melting temperature in the downstream barrel zones of said extrusion device, and the temperature range for mixing the polymer composite and initiator in the upstream barrel zones of said extrusion device is from about the melting temperature of the base resin to below the crosslinking onset temperature.

18. A process in accordance with claim 1 comprising preblending said polymer composite, a chemical initiator, additional base resin and toner additives to form a preblend, and feeding said preblend to a continuous melt mixing apparatus.

19. A process in accordance with claim 18 wherein said toner additives include a charge control additive selected from the group consisting of alkyl pyridinium halides and distearyl dimethyl ammonium methyl sulfate.

20. A process in accordance with claim 1 further comprising the step of combining carrier particles with the toner obtained to form a developer, and wherein said toner is comprised of said crosslinked toner resin and pigment.

21. A process in accordance with claim 1 wherein said pigment amount in said base resin is in the range of from about 1 to about 20 percent by weight.

22. A process in accordance with claim 1 wherein said crosslinked toner resin comprises crosslinked portions and linear portions, wherein said crosslinked portions comprise very high molecular weight gel particles with high density crosslinking and containing well dispersed pigment and optional toner additives, wherein said gel particles are less than about 0.3 micron in diameter and are substantially uniformly distributed in said resin, and wherein said linear portions are linear unsaturated polyesters having a number-average molecular weight ($M_n$) as measured by gel permeation chromatography in a range of from about 1,000 to about 20,000, a weight-average molecular weight ($M_w$) of from about 2,000 to about 40,000, a molecular weight distribution ($M_w/M_n$) of about 1.5 to about 6, an onset glass transition temperature (Tg) as measured by differential scanning calorimetry in the range of from about 50° C. to about 70° C., and a melt viscosity as measured with a mechanical spectrometer at 10 radians per second of from about 5,000 to about 200,000 poise at 100° C., said melt viscosity dropping with increasing temperature to from about 100 to about 5,000 poise at 130° C.

23. A process in accordance with claim 1 wherein said crosslinked toner resin comprises crosslinked portions and linear portions, wherein said crosslinked portions are in the form of microgels less than 0.3 micron in particle diameter, containing well dispersed pigment and other toner additives, and are substantially uniformly distributed in said resin, wherein the amount of crosslinked portions or gel content is in the range from about 0.001 to about 50 percent by weight of said toner resin, wherein the amount of linear portion is in the range of about 50 to about 99.999 percent by weight of said toner resin, and wherein said resin has an onset glass transition temperature in the range of from about 50° C. to about 70° C., and melt viscosity at 10 radians per second of from about 5,000 to about 200,000 poise at 100° C. and from about 10 to about 20,000 poise at 160° C.

24. A process in accordance with claim 23 wherein said toner resin provides a minimum fix temperature for the toner product of from about 100° C. to about 160° C., a hot offset temperature of toner of from about 110° C. to about 220° C., and substantially no vinyl offset, and wherein said toner product is comprised of said crosslinked toner resin and said pigment.

25. A process in accordance with claim 1 wherein substantially no unpigmented gel particles are contained in the toner product, and there is enabled a uniform distribution of pigment in the toner.

26. A process in accordance with claim 1 wherein said pigment is coated with said base resin, and is thereby passivated.

27. A process for the preparation of toner compositions consisting of (a) preparing a polymer composite consisting essentially of a reactive linear unsaturated polyester base resin and pigment by melting the base resin, and enabling dispersing of said pigment in said resin; subsequently cooling; and (b) melting by heating and shearing the resultant composite of (a) with additional base resin and free radical initiator, thereby forming a polymer composite melt of resin, initiator, and pigment, and crosslinking the resin component to form a crosslinked toner resin with substantially no unpigmented gel domains, and wherein the initiator is a chemical initiator and functions as a crosslinking agent; and wherein there is partial crosslinking of said resin of from about 20 to about 75 weight percent, and wherein the blend of base resin and pigment in (a) is subjected to melt mixing during said melting of said base resin wherein the pigment is dispersed in and wetted by said base resin in said polymer composite, and said additional base resin of (b) is a linear unsaturated polyester resin, and wherein said linear unsaturated polyester resin possesses a number-average molecular weight ($M_n$) as measured by gel permeation chromatography (GPC) in the range of from about 1,000 to about 20,000, a weight-average molecular weight ($M_w$) in the range of from about 2,000 to about 40,000, a molecular weight distribution ($M_w/M_n$) in the range of from about 1.5 to about 6, an onset glass transition temperature ($T_g$) as measured by differential scanning calorimetry in the range of from about 50° C. to about 70° C., and a melt viscosity as measured with a mechanical spectrometer at 10 radians per second of from about 5,000 to about 200,000 poise at 100° C., said melt viscosity dropping with increasing temperature to from about 100 to about 5,000 poise at 130° C., and wherein said pigment is carbon black.

* * * * *